US005435643A

United States Patent [19]

Kennedy

[11] Patent Number: 5,435,643

[45] Date of Patent: Jul. 25, 1995

[54] COMBINED SEAT/SIDE-BY-SIDE COOLER/EQUIPMENT STORAGE DEVICE

[75] Inventor: Thomas A. Kennedy, New Hope, Pa.

[73] Assignee: T.A.K. Enterprises, Inc., Flemington, N.J.

[21] Appl. No.: 227,068

[22] Filed: Apr. 13, 1994

Related U.S. Application Data

[63] Continuation-in-part of Ser. No. 213,151, Mar. 14, 1994.

[51] Int. Cl.[6] ..... A47B 83/02; A47B 3/14

[52] U.S. Cl. ..... 312/235.2; 297/188.11; 297/188.13

[58] Field of Search ..... 312/235.1, 235.9, 236, 312/241, 270.3, 270.1; 297/188.08, 188.11, 188.13, 344.26, 344.12, 344.18, 344.21; 206/315.11

[56] References Cited

U.S. PATENT DOCUMENTS

| | | | |
|---|---|---|---|
| D. 256,630 | 9/1980 | Maney | D7/605 |
| 780,933 | 1/1905 | Brown | 297/344.18 X |
| 1,356,558 | 10/1920 | Purcell | 297/344.12 X |
| 2,264,744 | 12/1941 | Dunnam | 297/188.13 |
| 2,812,227 | 11/1957 | Hill | 312/235.2 X |
| 3,230,006 | 1/1966 | Sokolis | 312/235.2 X |
| 3,310,905 | 3/1967 | Davis | 206/315.11 X |
| 4,210,363 | 7/1980 | Taipalus | 297/192 |
| 4,248,476 | 2/1981 | Phelps | 297/188.11 X |
| 4,353,182 | 10/1982 | Junkas et al. | 312/235.5 X |
| 4,474,407 | 10/1984 | Nazar | 297/192 |
| 4,556,250 | 12/1985 | Chapman et al. | 312/235.2 |
| 4,682,813 | 7/1987 | Fohr et al. | 297/344.21 X |
| 4,773,709 | 9/1988 | Slinkard | 297/193 |
| 4,775,187 | 10/1988 | Herr | 297/344.22 X |
| 4,854,261 | 8/1989 | Goldsmith | 312/235.2 X |
| 5,100,198 | 3/1992 | Baltzell | 312/235.2 |
| 5,209,178 | 5/1993 | Rowe | 297/217 X |
| 5,234,143 | 8/1993 | Mahvi et al. | 224/31 |
| 5,364,163 | 11/1994 | Hardison | 297/344.26 X |

OTHER PUBLICATIONS

Coleman of Wichita, Kansas—K-Mart Sales brochure/Winter 1993.

Rubbermaid of Akron, Ohio—K-Mart sales brochure/-Winter 1993.

Plano Corporation of Plano, Illinois—Field & Stream and Outdoor Life/both Nov. 1993.

Bass Pro of St. Louis, Missouri—Pro Bass Magazine/-Fall 1993.

*Primary Examiner*—Kenneth J. Dorner
*Assistant Examiner*—Robert J. Sandy
*Attorney, Agent, or Firm*—Kenneth P. Glynn

[57] ABSTRACT

The present invention is a combination portable cooler and side-by-side seat-gear, equipment and food storage and transporting device. It includes a main housing having a closed bottom, sidewalls, a top and a front. The housing has inner walls and outer walls and has heat insulation therebetween. It includes an open front with at least one hinged door thereon, and it contains a plurality of horizontal drawer supports with a plurality of drawers slidably located within the housing. There is a seat located on the top of the housing, as well as handles for manually carrying same or straps for use as a backpack. In addition, located side-by-side and permanently attached thereto, either integrally or otherwise, is a top-opening cooler. It may optionally include an external shelf which is movable relative to the housing so as to have a first position which is a rest position, and to have a second position which is an open position.

20 Claims, 3 Drawing Sheets

COMBINED SEAT/SIDE-BY-SIDE COOLER/EQUIPMENT STORAGE DEVICE

REFERENCE TO RELATED APPLICATION

The present application is a continuation-in-part of copending U.S. patent application Ser. No. 08/213,151, filed on Mar. 14, 1994, by the same inventor herein and entitled "Combined Cooler-Seat Sports Gear Box".

BACKGROUND OF THE INVENTION

1. Field of the Invention

The present invention is directed to a combination device which acts as a portable seat and storage device and a side-by-side cooler. More specifically, the present invention involves such devices as will permit access to various storage areas without removal of other storage areas. The present invention device may be used for sports activities or any other outdoor activities which may require waiting, seating, food storage and possible storage of gear or equipment. It may be in the form of a backpack and may, for example, be used as a fishing tackle box-cooler-seat.

2. Description of the Prior Art

Campers, hunters, fishermen and other people involved in other outdoor activities have used various types of coolers as well as various types of tackle boxes and sports gear boxes. Coleman of Wichita, Kans. manufactures single area coolers and multiple compartment coolers, and Rubbermaid of Akron, Ohio likewise manufactures and sells multiple compartment coolers. However, these all have lids which are hinged at the top horizontally and swing up to open or are removable upwardly to open. A sales brochure from K-mart, from Winter of 1993, illustrates Coleman coolers as well as Rubbermaid coolers, all with open tops. Tackle boxes have been developed by Plano Corporation of Plano, Ill. and these include stowaway tackle boxes with top and front openings as shown on the two pages from Field & Stream and Outdoor Life, both November, 1993.

Some coolers have been adapted to include seats and straps and Bass Pro of St. Louis, Mo., sells padded stools with swivelling seats which include storage bags underneath. Bass Pro also sells cooler stool fanny packs and separately sells rigid, top opening coolers with seats. These are shown on a one page sales brochure from the Fall 1993 issue of Pro Bass Magazine.

SUMMARY OF THE INVENTION

The present invention is a combination portable cooler and side-by-side seat-gear, equipment and food storage and transporting device. It includes a main housing having a closed bottom, sidewalls, a top and a front. The housing has inner walls and outer walls and has heat insulation therebetween. It includes an open front with at least one hinged door thereon, and it contains a plurality of horizontal drawer supports with a plurality of drawers slidably located within the housing. There is a seat located on the top of the housing, as well as handles for manually carrying same or straps for use as a backpack. In addition, located side-by-side and permanently attached thereto, either integrally or otherwise, is a top-opening cooler. It may optionally include an external shelf which is movable relative to the housing so as to have a first position which is a rest position, and to have a second position which is an open position.

BRIEF DESCRIPTION OF THE DRAWINGS

The present invention should be more fully understood when the specification herein is taken in conjunction with the drawings appended hereto, wherein.

DETAILED DESCRIPTION OF THE PRESENT INVENTION

Figure 1:
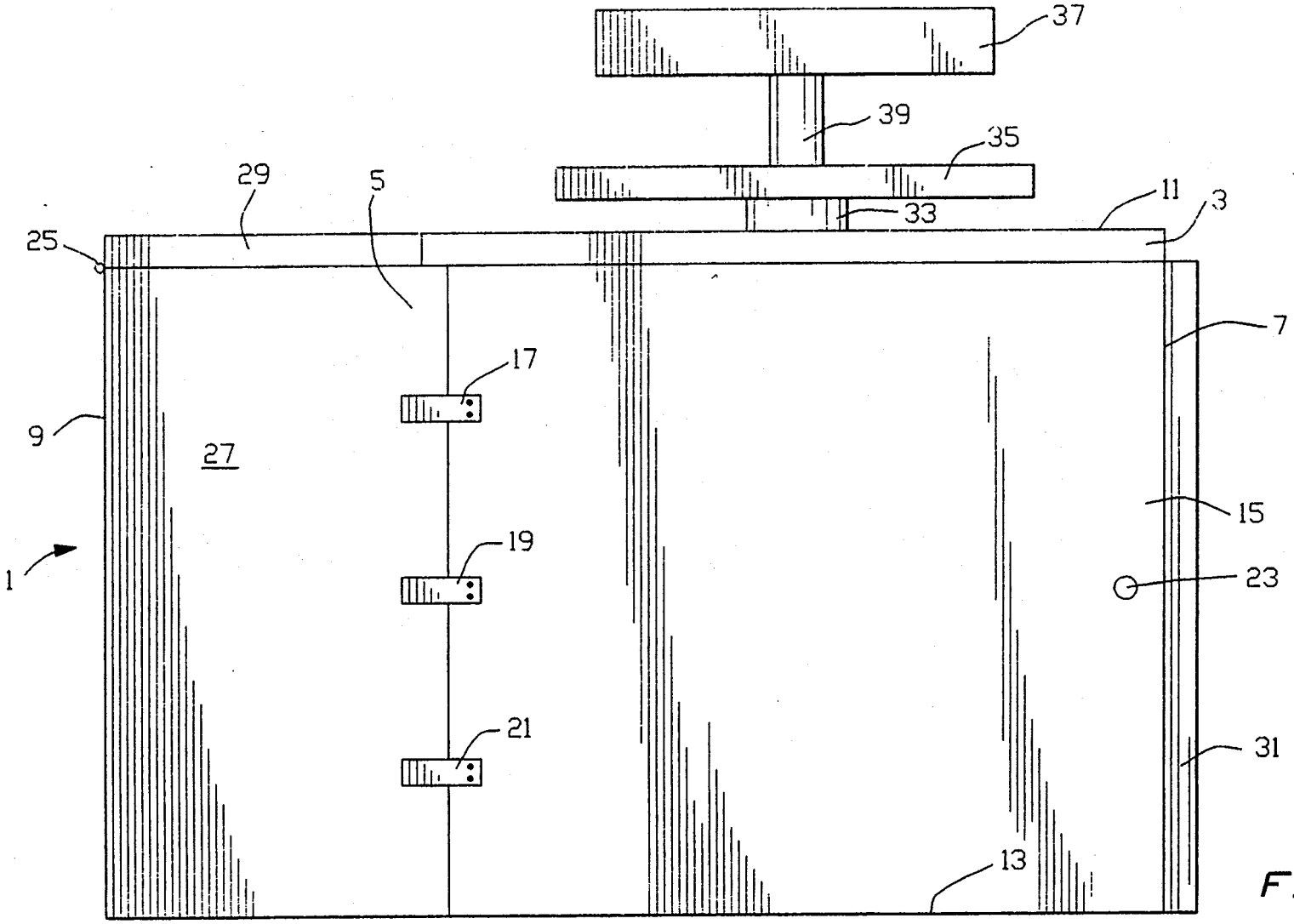
FIG. 1 shows a front view of a present invention device.

Referring now to FIG. 1, there is shown a front view of present invention device 1. Device 1 is a combined cooler-seat-storage and transporting device with the cooler and the seat being arranged side-by-side to enable access to the cooler without removal of the user from the seat. It may advantageously be used for sports, especially for hunting and fishing, and for other outdoor activities such as camping, outdoor spectator events, local sports games, e.g. high school or little league football, soccer or baseball games, beach going, canoeing, boating, outdoor painting, temporary outdoor stands such as at flea markets, as well as thousands of other uses immediately foreseeable to the artisan once the device is described. The device can be used to provide a seat, while providing separate storage areas for sports gear, ammunition, fishing tackle, lures, camping equipment, etc., and for food which may be kept cool due to the insulative cooler aspects of the present invention.

Device 1 includes a main housing 3 with a front 5 and sidewalls 7 and 9 and a back (not shown), as well as a top 11 and a bottom 13. It has generally rectangular surfaces, as shown. There are handling means (shown in other Figures) located on sidewalls 7 and 9 respectively. Also, front 5 has a door 15, as shown, with opening finger recess 23 and hinges 17, 19 and 21. There is a left side section, cooler compartment 27, which includes a cooler top lid 29. For direct access, lid 29 hinges on hinge 25 for easy opening by a user while sitting or standing. On the right side is an optional pull out shelf 31. At top 11 is a swivel post 33 and a swivel seat 35 with back rest 37 and rest support 39.

Figure 2:
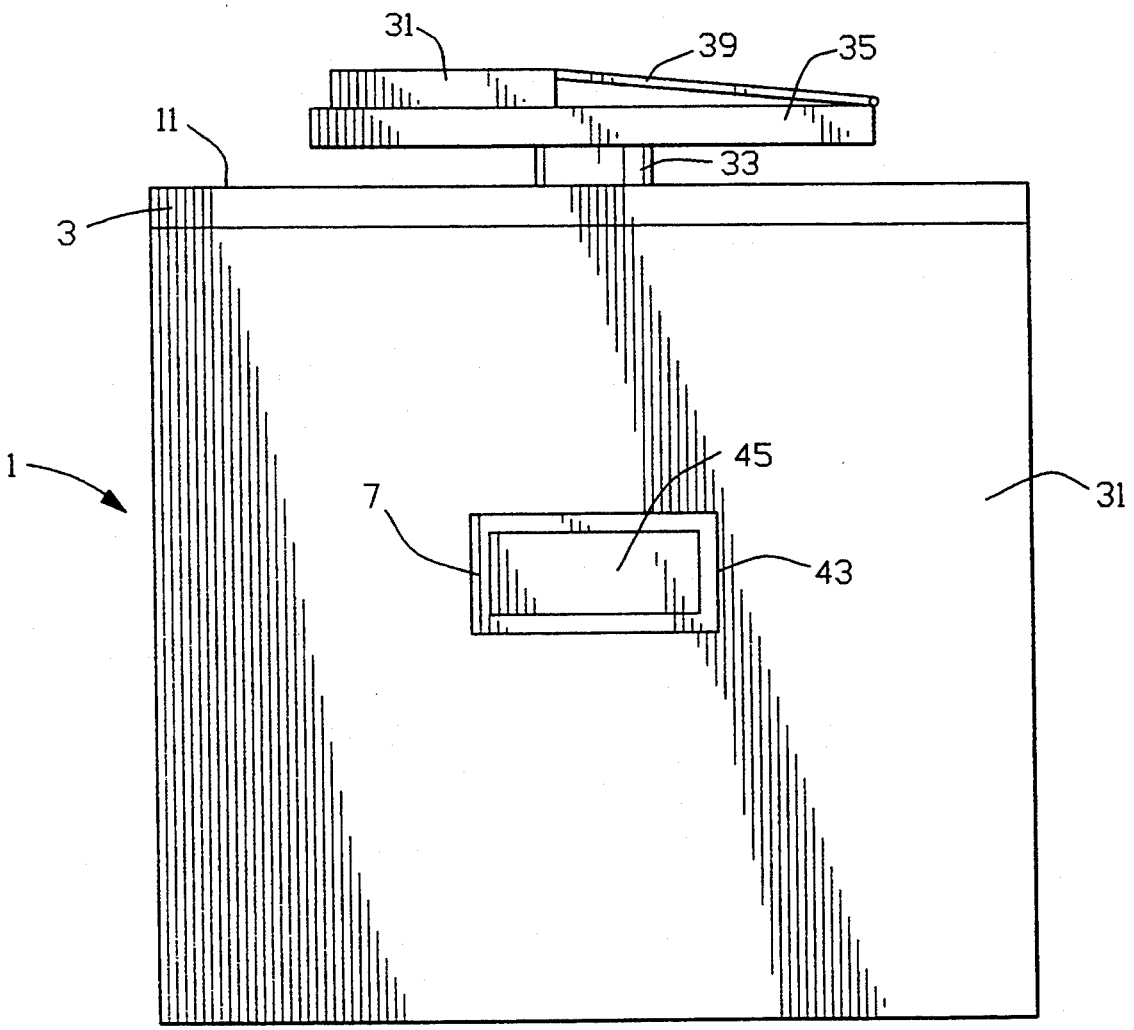
FIG. 2 shows a right side view of the device shown in FIG. 1.

FIG. 2 shows a side view of device 1 but now showing seat back rest 37 in the folded position, via snap hinge 41. Pull out shelf 31 has an orifice 43 exposing side wall 7 and recessed handle 45, as shown. A similar, recessed handle is located on the opposite side (not shown). All other aspects that are shown in FIG. 1 are identically numbered.

Figure 3:
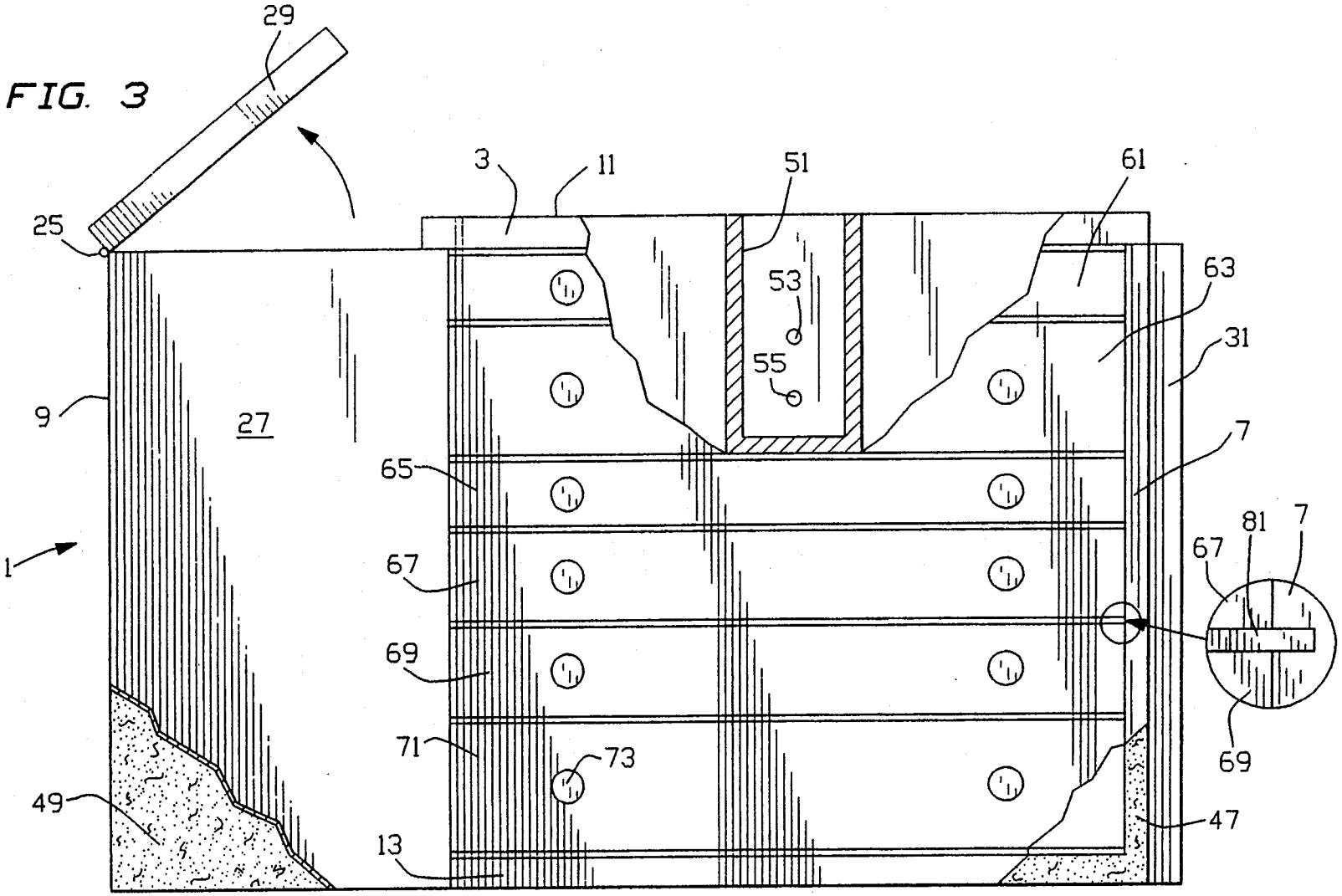
FIG. 3 shows a partially cut front view of the device shown in FIGS. 1 and 2 with the door removed.

FIG. 3 shows a partially cut front view of the device shown in FIG. 1 and all identical parts are identically numbered. Lid 29 is shown in the partially open position, allowing top access to cooler compartment 27. Alternatively, cooler 27 could be front opening instead of top opening without exceeding the scope of the present invention. Top 11 is partially cut to expose column support 51 adapted for receiving swivel post 33. Orifices such as orifices 53 and 55 may be used to render swivel post 33 telescopic for various height adjustments utilizing, for example, pins. Alternatively, any other known adjustable and/or telescopic mechanisms may likewise be used. Drawers 61, 63, 65, 67, 69 and 71 are of various sizes and drawers 61 and 63 may be U-shaped to form around column support 51. The various drawers are opened, for example, by finger recesses such as finger recess 73 on drawer 71. Note that the cut portion of bottom 14 and side wall 7 expose insulation 47 and, thus, these drawers may be used to store cold or hot items, as well as ambient temperature food, equipment or other items. Cooler section 27 is likewise insulated as exemplified by insulation 49 shown in the left hand lower corner. The drawers are supported by, for example, support 81 shown in the enlargement of FIG. 3.

The present invention devices afford access to different storage areas without removal of unneeded storage areas. Thus, unlike the prior art, top lid devices with seats requiring the user to get up and then remove layers of boxes, bins, drawers or goods to get at lower goods, the present invention device permits immediate, direct access to any level in the front section and access without getting up to the side-by-side cooler section. Also, these drawers may include ice or cooler packs or not, depending upon desired use, and the drawers themselves may be modular and have removable or movable sections so as to be adapted to specific needs, e.g. fishing lures, lunch, beer, caught fish, ammunition, cold food, room temperature food, maps, knife, paper or plastic products, e.g. plates, etc. Obviously, numerous modifications and variations of the present invention are possible in light of the above teachings. For example, the carrying means may be straps instead of handles and could even be arranged with dual shoulder straps for transport as a backpack. It is therefore understood that within the scope of the appended claims, the invention may be practiced otherwise than as specifically described herein.

What is claimed is:

1. A combination cooler-seat-equipment storage and transporting device, which comprises:

a) a main housing having two separate main compartments, said first compartment being a front opening storage compartment and said second compartment being side-by-side to said first compartment and being a cooler, both of said compartments having a closed bottom, sidewalls, a top and a front, and having inner walls and outer walls and having heat insulation therebetween, said first compartment further having an open front with a hinged door thereon, said door also having inner walls and outer walls with heat insulation therein, said first compartment further containing a plurality of horizontal drawer supports thereon, said second compartment being a top opening compartment having a top lid for access thereto;

b) a plurality of drawers located within said first compartment and slidably connected to said drawer supports for horizontal opening and closing thereof;

c) a seat located on said top of said first compartment of said housing so as to be side-by-side with said second compartment of said housing; and, d) handling means on said housing for manually carrying same.

2. The device of claim 1 wherein said main housing is generally rectangular in shape.

3. The device of claim 1 wherein said housing further includes an external shelf which is movable relative to said housing so as to have a first position which is a rest position wherein said shelf is substantially contiguous to said housing, and to have a second position which is an open position wherein said shelf is in an exposed horizontal position.

4. The device of claim 3 wherein said external shelf is hingedly mounted on the outside of said housing in a vertical position for its rest position and is rotated into a horizontal position for its open position.

5. The device of claim 4 wherein said shelf is attached to said first compartment of said main housing.

6. The device of claim 1 wherein at least a portion of said plurality of drawers are located inside said first compartment of said housing behind said door.

7. The device of claim 1 wherein said seat is a swivel seat.

8. The device of claim 1 wherein said seat includes a back support member.

9. The device of claim 8 wherein said back support member is foldable.

10. The device of claim 7 wherein said seat includes a back support member.

11. The device of claim 10 wherein said back support member is foldable.

12. The device of claim 1 wherein said seat is an adjustable seat.

13. The device of claim 12 wherein said adjustable seat is telescopic.

14. The device of claim 7 wherein said seat is an adjustable seat.

15. The device of claim 14 wherein said adjustable seat is telescopic.

16. The device of claim 8 wherein said seat is an adjustable seat.

17. The device of claim 16 wherein said adjustable seat is telescopic.

18. The device of claim 3 wherein said seat is an adjustable seat which includes a foldable back support member.

19. The device of claim 4 wherein said seat is an adjustable seat which includes a foldable back support member.

20. The device of claim 5 wherein said seat is an adjustable seat which includes a foldable back support member.

* * * * *